US009815219B2

(12) United States Patent
Claussen et al.

(10) Patent No.: US 9,815,219 B2
(45) Date of Patent: Nov. 14, 2017

(54) ROTARY STRIP CUTTER

(71) Applicant: West Liberty Foods LLC, West Liberty, IA (US)

(72) Inventors: Edward Claussen, West Liberty, IA (US); Gerald Lessard, West Liberty, IA (US); Todd Bailey, West Liberty, IA (US)

(73) Assignee: West Liberty Foods, LLC, West Liberty, IA (US)

( * ) Notice: Subject to any disclaimer, the term of this patent is extended or adjusted under 35 U.S.C. 154(b) by 177 days.

(21) Appl. No.: 14/216,870

(22) Filed: Mar. 17, 2014

(65) Prior Publication Data

US 2014/0260857 A1 Sep. 18, 2014

Related U.S. Application Data

(60) Provisional application No. 61/793,937, filed on Mar. 15, 2013.

(51) Int. Cl.

| | |
|---|---|
| ***B26D 7/32*** | (2006.01) |
| ***B26D 7/06*** | (2006.01) |
| ***B26D 1/36*** | (2006.01) |

(52) U.S. Cl.

CPC ..... *B26D 7/32* (2013.01); *B26D 1/36* (2013.01); *B26D 7/0625* (2013.01); *Y10T 83/2192* (2015.04)

(58) Field of Classification Search

CPC ..... Y10T 83/2192; Y10S 83/932; B26D 7/32; B26D 1/36

USPC ..... 83/155, 932; 198/577, 572

See application file for complete search history.

(56) References Cited

U.S. PATENT DOCUMENTS

| | | | | |
|---|---|---|---|---|
| 2,724,350 | A * | 11/1955 | Rerucha | A21C 11/00 83/155 |
| 4,238,024 | A * | 12/1980 | Hirakawa | B65G 47/082 198/418.9 |
| 5,718,157 | A * | 2/1998 | Hawley | B65B 69/0025 241/605 |
| 6,634,486 | B2 * | 10/2003 | Bennett | B65B 57/04 198/631.1 |
| 7,114,613 | B2 * | 10/2006 | Brouwer | B65G 13/04 198/784 |
| 2003/0019723 | A1 * | 1/2003 | Rudy | B26D 7/20 198/493 |
| 2005/0279228 | A1 * | 12/2005 | Julian | B26D 1/26 99/537 |
| 2006/0107808 | A1 * | 5/2006 | Culling | B26D 7/32 83/91 |

* cited by examiner

*Primary Examiner* — Omar Flores Sanchez
(74) *Attorney, Agent, or Firm* — Davis, Brown, Koehn, Shors & Roberts, P.C.; Matthew Warner-Blankenship

(57) ABSTRACT

The present invention relates to apparatus, systems and methods for manufacturing food, more specifically strip products out of meats such as chicken, of variable thickness and texture, in various shapes and sizes.

13 Claims, 12 Drawing Sheets

ROTARY STRIP CUTTER

CROSS-REFERENCE TO RELATED APPLICATION(S)

This application claims priority from U.S. Provisional Application 61/793,937, filed Mar. 15, 2013, and entitled "Rotary Strip Cutter" which is hereby incorporated herein by reference in its entirety.

TECHNICAL FIELD

The present disclosure relates to apparatus, systems and methods for manufacturing food, more specifically strip products out of meats such as chicken, of variable thickness and texture, in various shapes and sizes.

BACKGROUND

The present disclosure relates to apparatus, systems and methods of food processing, and more specifically to the field of portion cutting of food items, especially meat products, in pieces of predetermined shapes, such as quadratic pieces of meat.

Within the food production industry, there is demand for special cuts of meat, an example of these being special portion cuts of poultry such as chicken, particularly strips of generally uniform size, preferably pre-cooked, for ease of preparation for the consumer. As is well-known in the art, the such meat generally begins as de-boned leg and breast meat, where the remaining meat and skin are made "smooth" in one piece.

There is a need in the art for apparatus, systems and methods for high output production of food portions of specific dimensions.

BRIEF SUMMARY

Disclosed herein is an apparatus for cutting a food product into strips, comprising: an in-feed skewing conveyor; a housing, further comprising a rotating head, wherein the rotating head cuts said product; and an out-feed conveyor. In certain embodiments, the food product is meat. In certain aspects, the rotating head cuts the product leaving an uncut margin. In further aspects, the uncut margin is between about 1/16" and 1/64" thick. In still further aspects, the uncut margin is about 1/32" thick.

The disclosed system, apparatus and methods for cutting a meat product into strips, comprising: an in-feed skewing conveyor; a housing, further comprising a rotating head, wherein the rotating head cuts said product; and an out-feed conveyor further comprising a variable speed control configuration.

Certain exemplary embodiments of the disclosure comprise an apparatus for cutting a meat product into strips, comprising: an in-feed skewing conveyor; a housing, further comprising a rotating head, wherein the rotating head cuts said product; and an out-feed conveyor; wherein said in-feed skewing conveyer further comprises a plurality of belts or conveyance strips, said belts or conveyance strips running generally parallel to one another, and the belts or conveyance strips are driven by sprockets and the sprockets have a generally increasing diameter from one side of the in-feed skewing conveyer to the other, such that said belts or conveyance strips are driven at an generally increasing rate of speed from one side of the skewing conveyer to the other, such that product traveling over the belts or conveyance strips is rotated.

While multiple embodiments are disclosed, still other embodiments of the strip cutter will become apparent to those skilled in the art from the following detailed description, which shows and describes illustrative embodiments of the invention. As will be realized, the invention is capable of modifications in various obvious aspects, all without departing from the spirit and scope of the strip cutter. Accordingly, the drawings and detailed description are to be regarded as illustrative in nature and not restrictive.

DETAILED DESCRIPTION

The various systems, devices and methods disclosed herein relate to food processing. More specifically, various embodiments relate to processing meats such as chicken of variable thickness and texture into various shapes and sizes. Although the apparatus, system and methods have been described with reference to certain exemplary embodiments, persons skilled in the art will recognize that changes may be made in form and detail without departing from the spirit and scope of the apparatus, systems and methods. Similarly, for brevity, the disclosed apparatus, systems and methods will be referred to herein variously, but without limiting the disclosure to a singular aspect. Further, the term "strip cutter" shall be read as encompassing the assorted devices, systems and methods.

As used herein "product" or "meat product" means meat-like products, including but not limited to poultry, beef, pork, mutton, lamb, veal, and fish. Imitation meat products, that is products of vegetal origin but designed to replicate the texture, taste, and/or appearance of meat are also included within the meaning of "product" or "meat product" as used herein.

Figure 1:
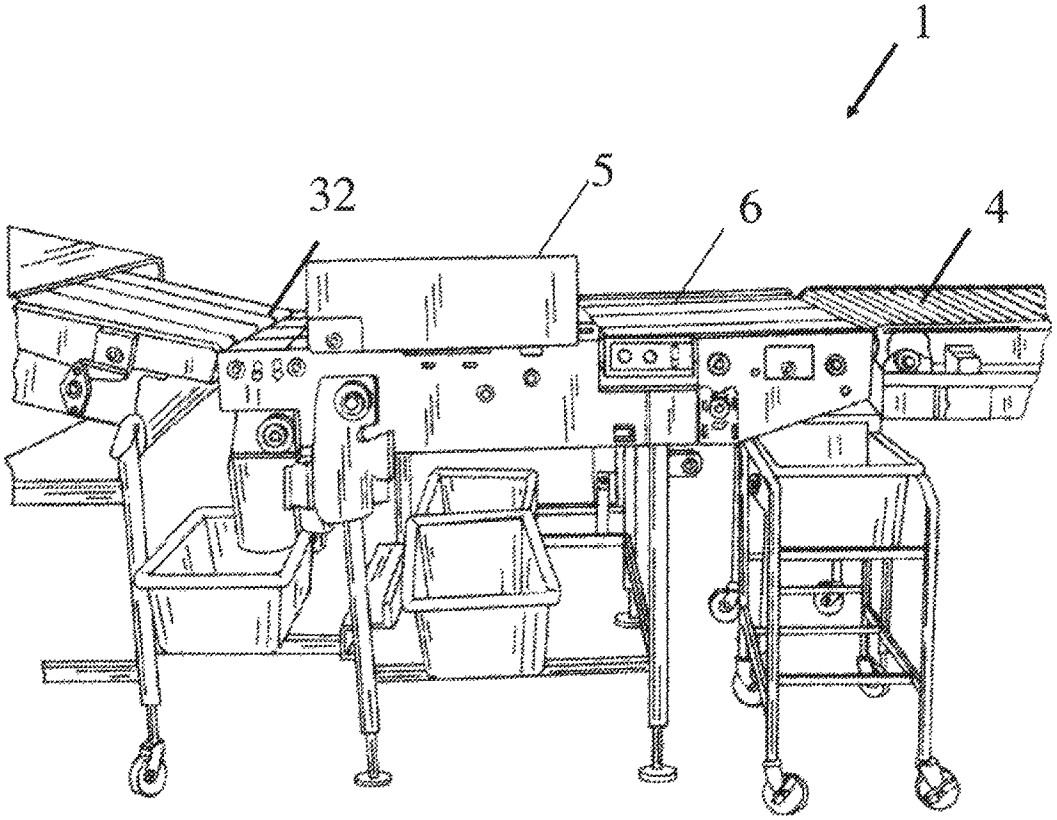
FIG. 1 is a upper side view of the strip cutter according to an exemplary embodiment.

As best shown in FIG. 1, certain embodiments of the strip cutter 1 comprise an in-feed skewing conveyor 6, a housing 5 containing a rotary head (depicted in FIG. 4), and an out-feed conveyor 32. In exemplary embodiments, the in-feed skewing conveyor 6, housing 5 and an out-feed conveyor 32 are oriented in sequence, such that a product 2 can be run through the strip cutter 1 in a substantially horizontal position for efficient processing. In certain embodiments, the product 2 can be spread across the strip cutter in a substantially sheet-like configuration. In various embodiments, this sheet can be approximately 40" wide—though as one of skill in the art would readily recognize any number of other sizes are possible.

As would be apparent to one of skill in the art, the product 2 can be of any length on the intake because the strip cutter can run substantially continuously. Further, the speed of the various conveyers and other operative components of the strip cutter can be operated at a variety of speeds to maintain a consistent processing speed throughout the strip cutter 1. Exemplary embodiments of the strip cutter 1 thus allow for a stream of product 2 to be fed into the housing 5 in-line with any upstream or downstream processing components while maintaining an even flow of product 2 through the strip cutter 1 for appropriate cooking and sizing.

Figure 2:
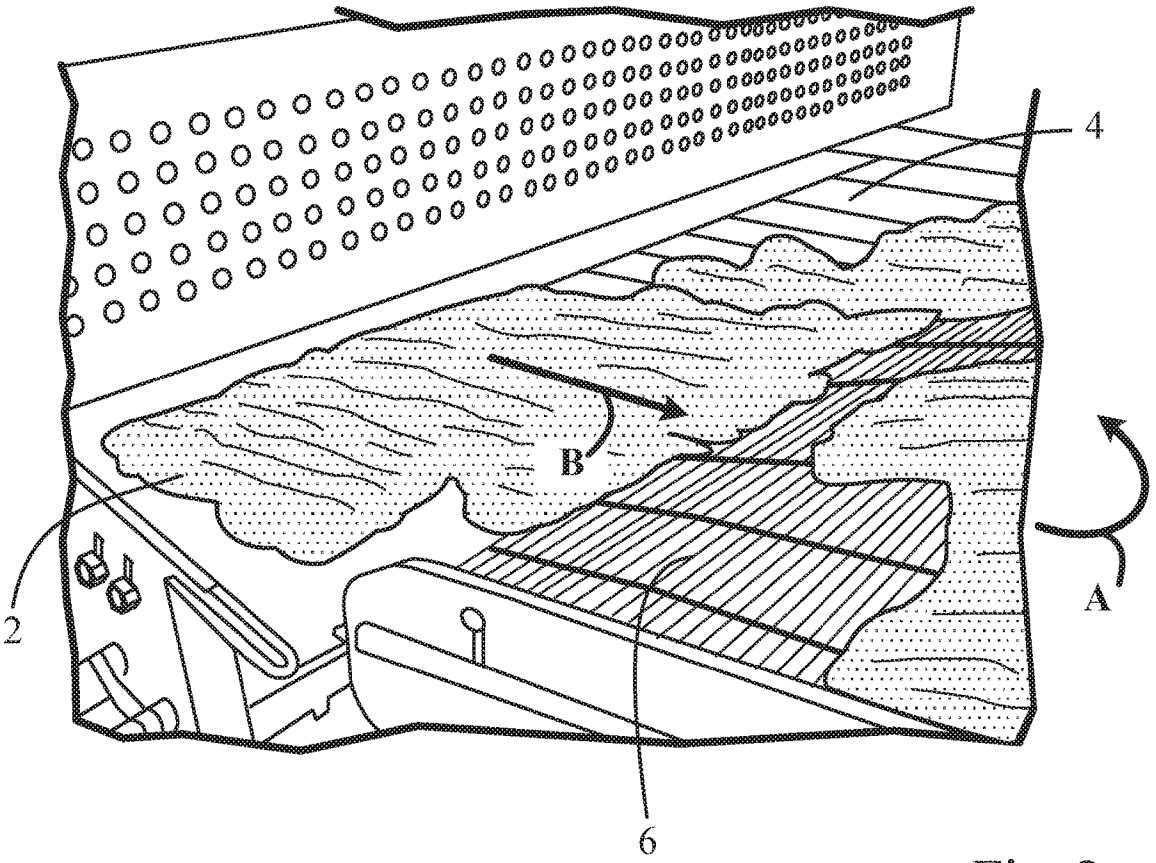
FIG. 2 is a perspective view of the strip cutter according to certain embodiments.
Figure 3:
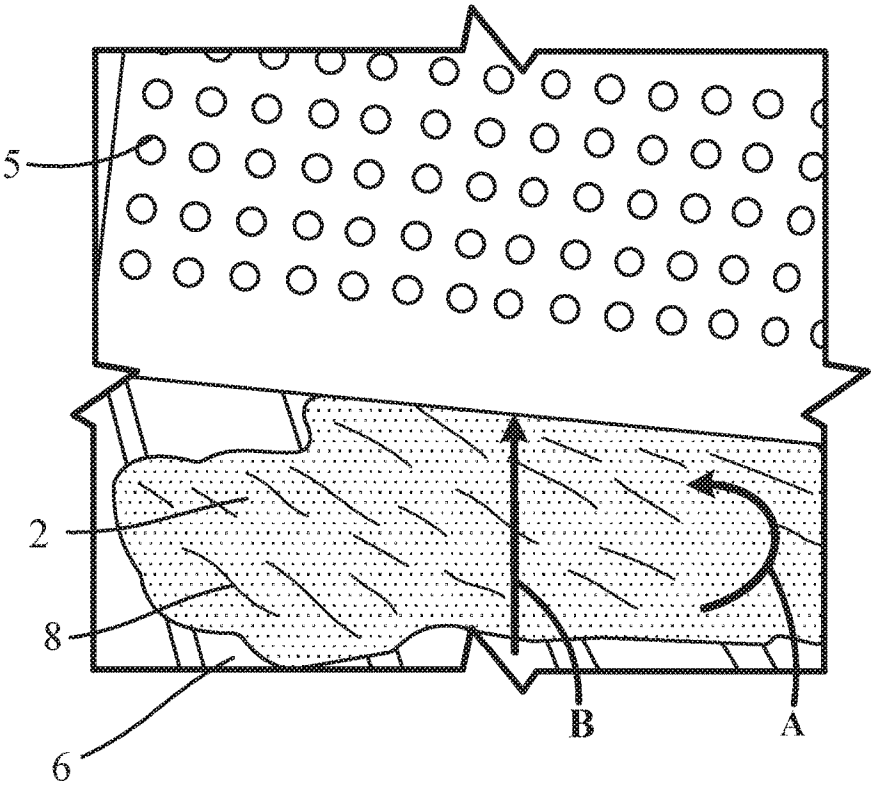
FIG. 3 is a detailed view of the strip cutter according to certain embodiments.
Figure 4:
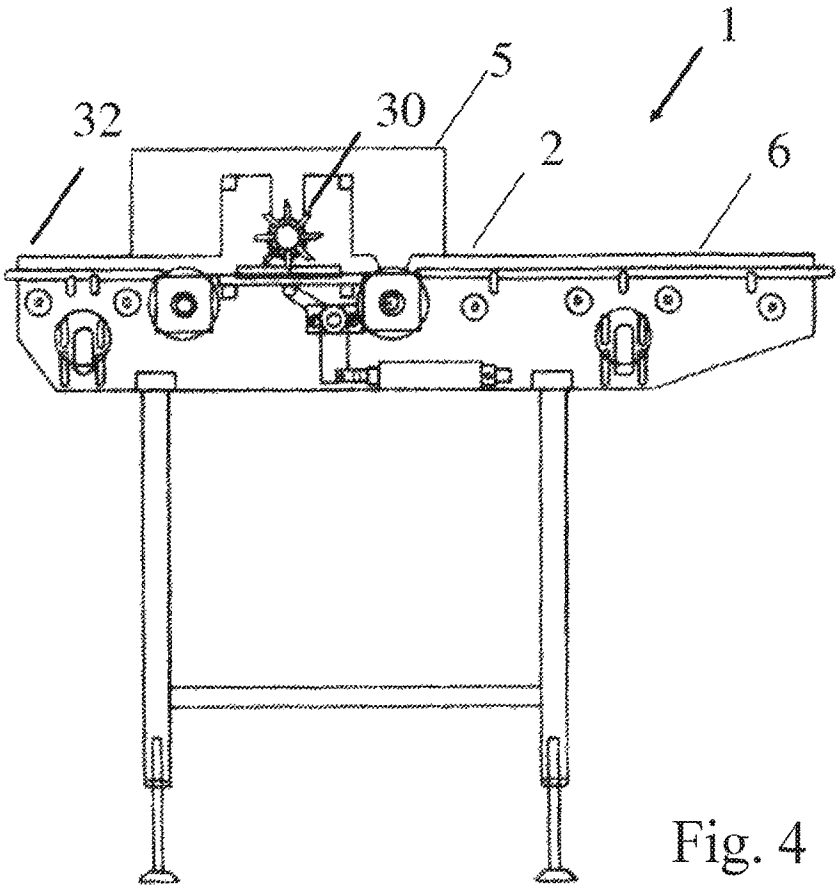
FIG. 4 is cross sectional side view of the strip cutter showing the rotary head according to certain embodiments.
Figure 12:
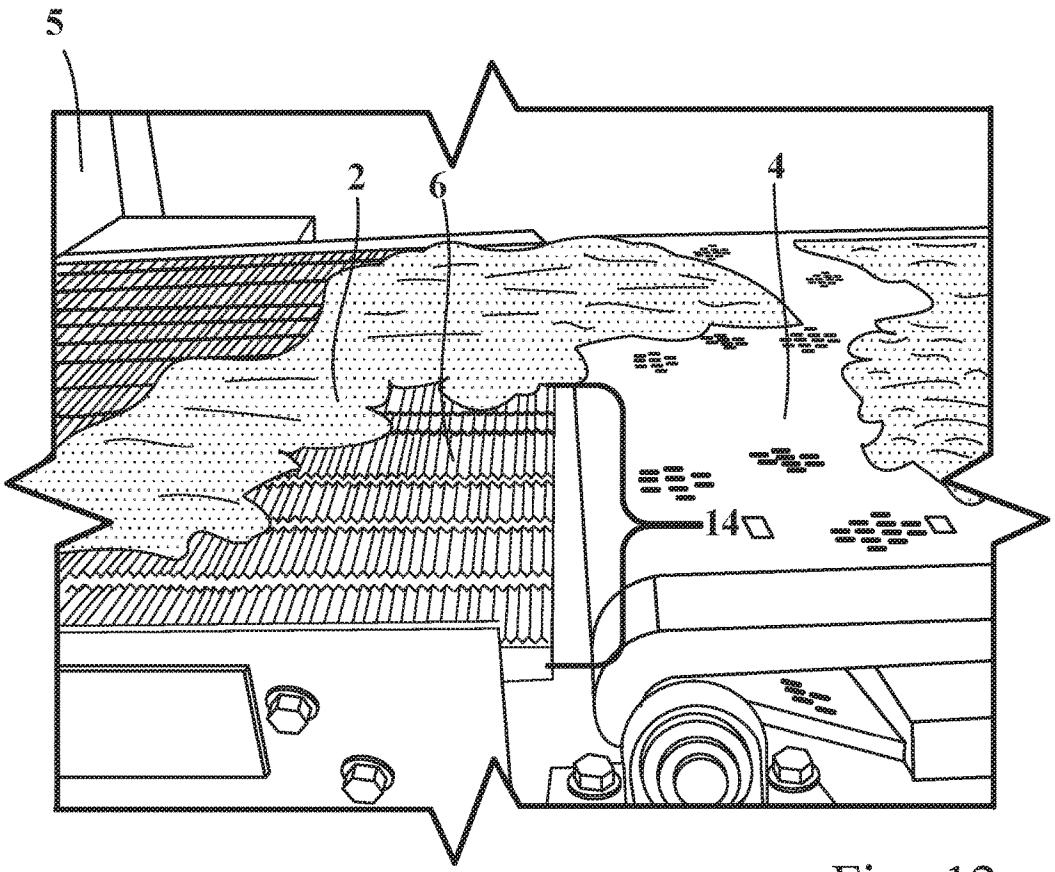
FIG. 12 is a detailed view of the strip cutter according to certain embodiments.

A principle aspect of the strip cutter is in-line product rotation prior to product cutting (as is best described in relation to FIG. 4). In various implementations, and as shown in FIGS. 2-3 and 12, the product 2 is fed into the strip cutter 1 from an upstream conveyer 4 onto an in-feed skewing conveyor 6. In certain embodiments, the product 2 is fed from other upstream line equipment (not shown), though this is not required. By way of example, in these embodiments, the product 2 undergoes processing by the upstream line equipment such that the product 2 fed onto to in-feed skewing conveyers 6 has already been cooked and/or order so as to be of a generally uniform thickness and texture. Further, in certain exemplary embodiments, upstream processing may create charring or "char" marks 8 on the product 2 with the char marks 8 in an orientation that generally parallel with direction of motion of the product through the strip cutter 1.

According to certain embodiments, as best seen in FIGS. 2-3, as the product 2 passes onto the in-feed skewing conveyor 6 from the upstream conveyer 4, the product 2 is rotated by the in-feed skewing conveyor 6, (as is further described in detail in relation to FIGS. 5-9). The rotation of the product 2 is such that char marks 8, previously parallel to the direction of movement, as depicted by reference letter B of the product 2, become angled with respect to the direction of movement (shown by reference arrow B), as is depicted by reference letter A. When the product 2 is subsequently cut (as is described in relation to FIG. 4), this rotation (A) yields a finished product that has the appearance of being cut on the bias with respect to the char marks 8.

Figure 9:
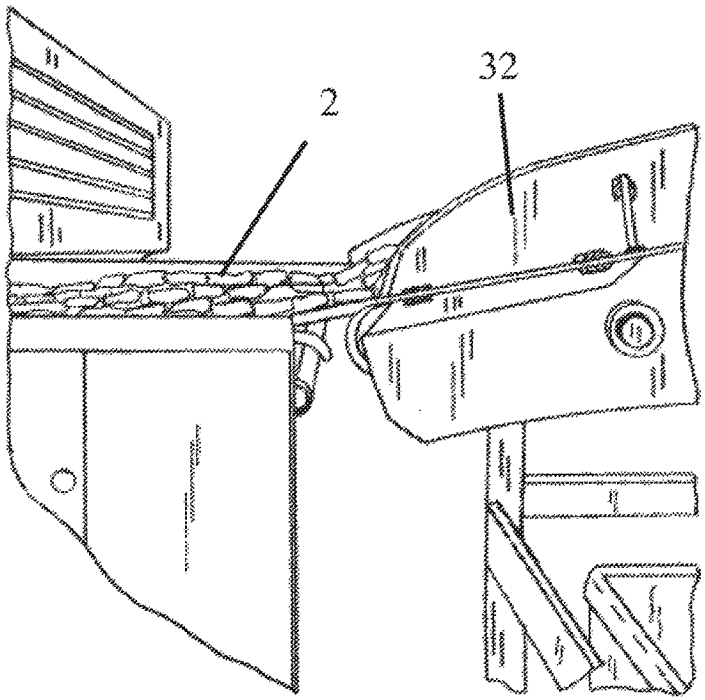
FIG. 9 is a side view of the out-feed conveyer of the strip cutter according to certain implementations.

FIG. 4 depicts an interior side-view of the strip cutter showing the rotary cutter 30 according to an exemplary embodiment. According to these embodiments, the product 2 is fed into the rotary cutter 30 by way of the in-feed skewing conveyor 6. In exemplary embodiments, the rotary cutter 30 functions to incise across the product 2 to within a very small margin of completely severing the product 2 (as is detailed further in relation to FIGS. 9-11), thus creating an uncut, or remaining margin. The remaining margin thus allows the strip cutter to retain the original configuration and/or orientation of the product 2 when passing onto the out feed conveyor 32, as best seen in FIG. 9. In certain embodiments, this remaining margin can be about 1/32". In further embodiments, the uncut margin is between about 1/4" and about 1/16". In still further embodiments, the uncut margin is between about 1/16" and about 1/32". In yet further embodiments, the uncut margin is between about 1/32" and about 1/64". One skilled in the art will appreciate that the desired thickness of the uncut margin will depend upon the characteristics of the product being cut.

Figure 5:
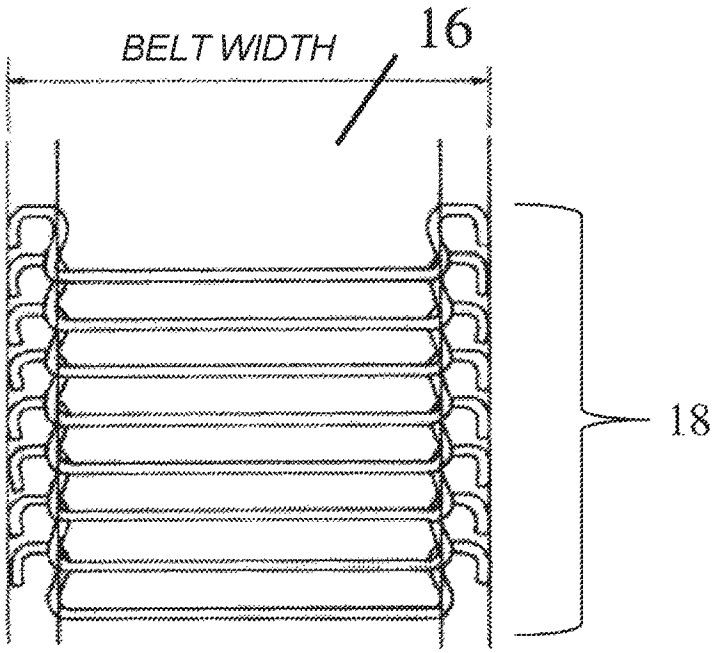
FIG. 5 is a top view of a segment of the one of the plurality of conveyance strips of the skewing conveyer according to certain embodiments.
Figure 6:
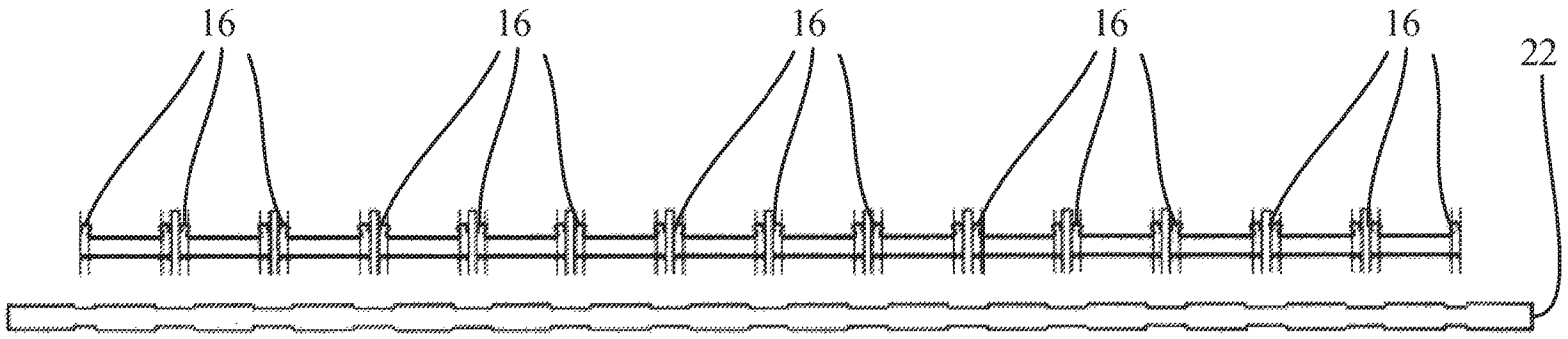
FIG. 6. is a cross sectional front view of the strip cutter belt frame according to certain exemplary embodiments.

In various embodiments, the in-feed skewing conveyor 6 further comprises a plurality of belts or conveyance strips or conveyance strips 14 running substantially parallel to one another. As best seen in FIGS. 5-6 and 12, each of the plurality of belts or conveyance strips 14 runs along one of a plurality of links 16 and is supported by plurality of braces 18.

Figure 7:
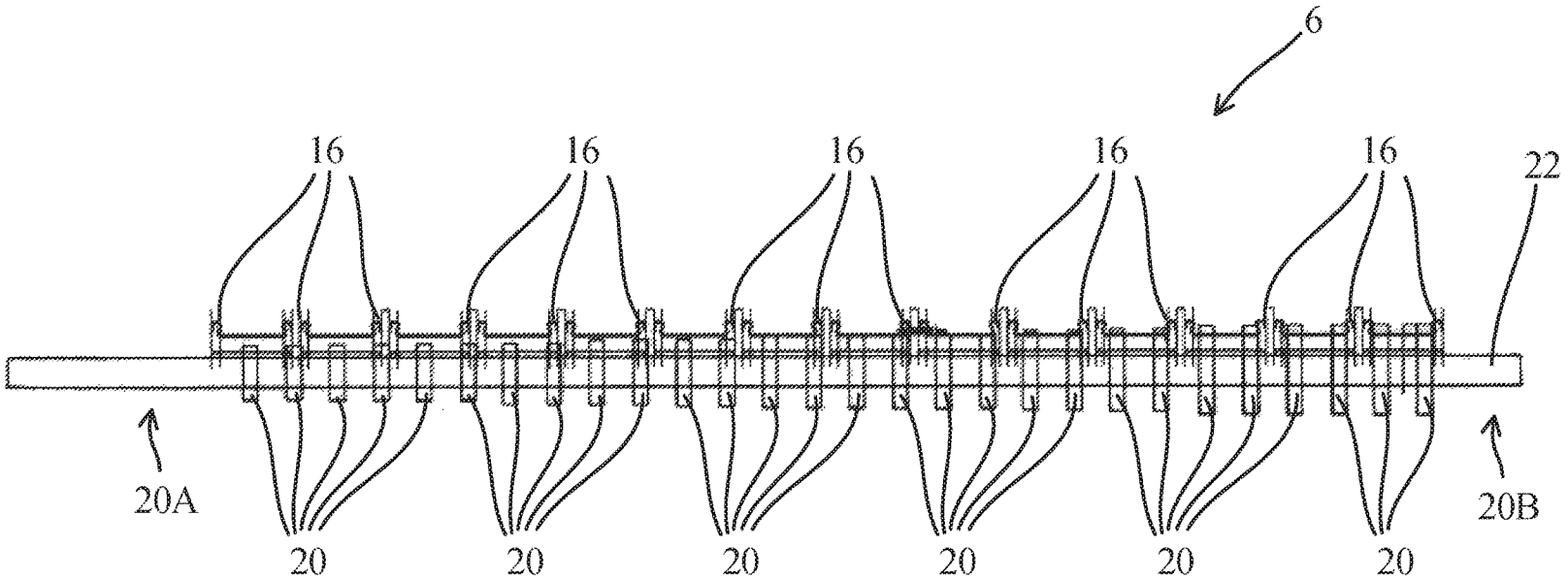
FIG. 7 is a cross sectional front view of the drive sprockets according to certain embodiments.
Figure 8A:
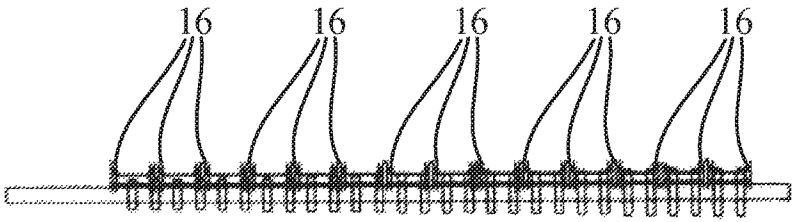
FIG. 8A is depicts a cross sectional view of the links, according to an exemplary embodiment.
Figure 8B:
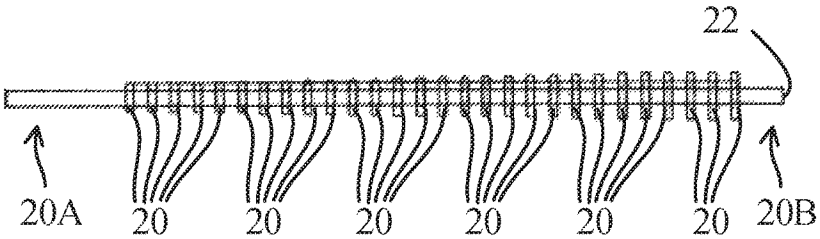
FIG. 8B depicts a cross-sectional view of the drive sprockets according to certain embodiments.

As can be appreciated from FIGS. 7-8B, the plurality of belts or conveyance strips 14 are driven by a plurality of drive sprockets 20. The plurality of drive sprockets 20 are driven by a drive shaft 22 (also shown in FIG. 6) with the drive shaft being driven by a drive motor (not shown). Across the width of the in-feed skewing conveyer 6, the drive sockets 20 have a generally increasing diameter from the first side 20A of the skewing conveyor to the second side 20B such that the plurality of belts or conveyance strips generally increase in speed from the first side of the in-feed skewing 20A conveyer to the second side of the conveyer 20B.

Figure 10:
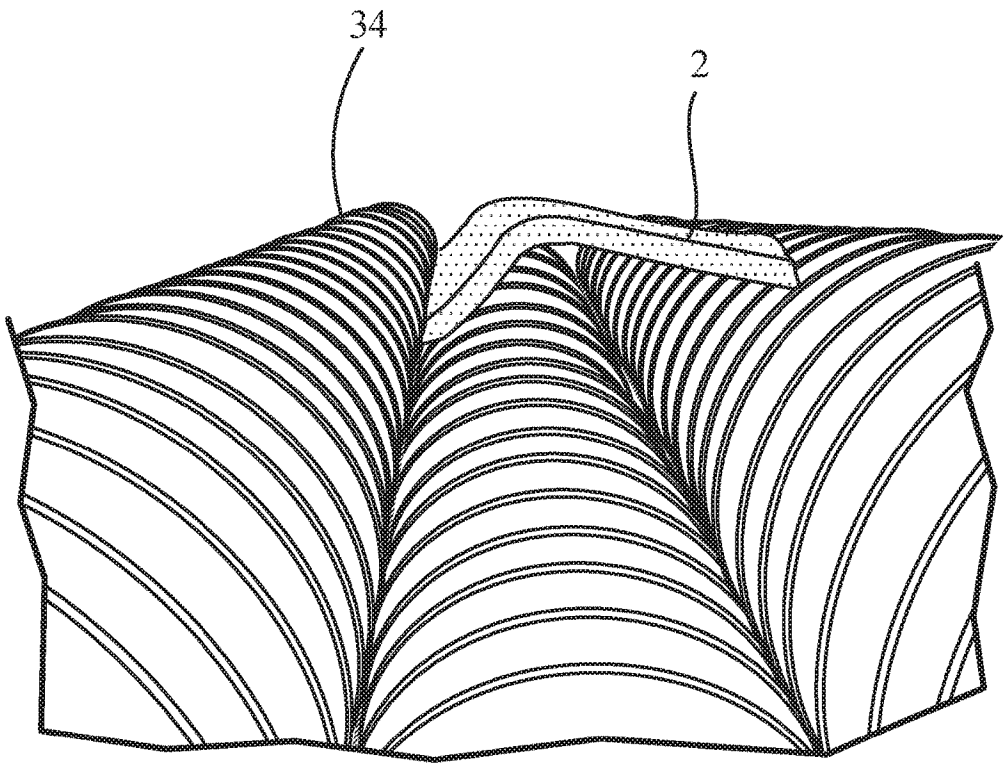
FIG. 10 is a detailed view of the inline width cutting member according to certain embodiments of the strip cutter.
Figure 11:
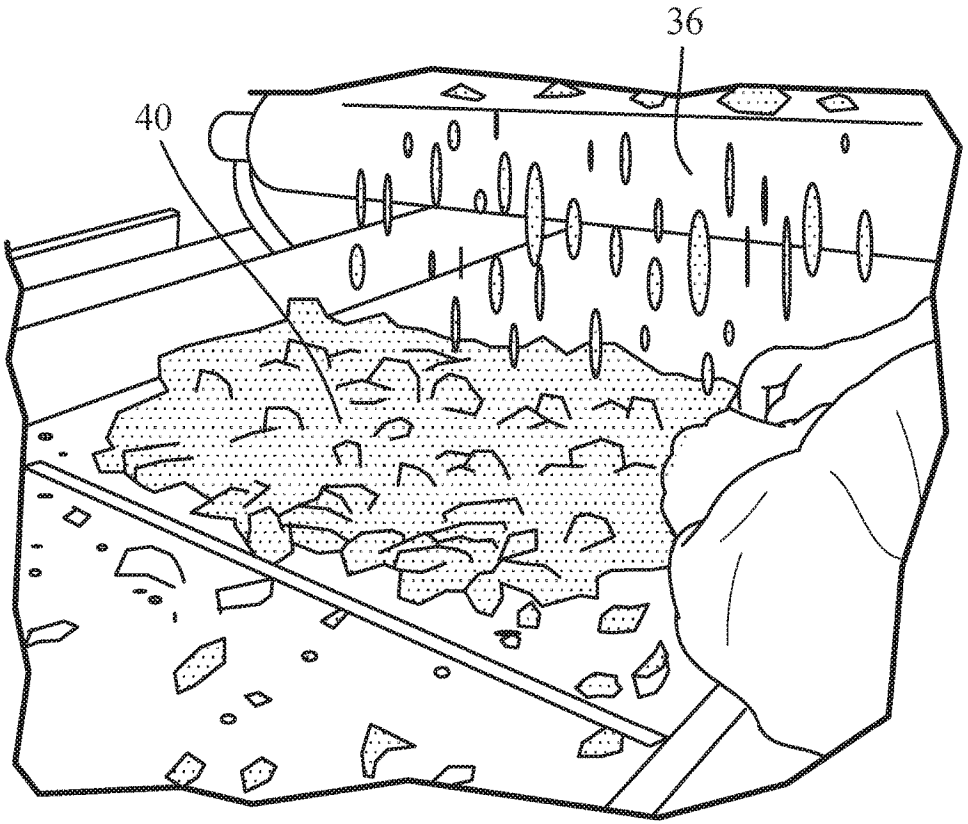
FIG. 11 is a detailed view of the water fall flow and final product according to certain embodiments.

As shown best in FIG. 9, another feature of certain embodiments is an out feed conveyor 32. In these embodiments, the out feed conveyor receives the product 2 that has been precut by the rotary head 30 thereby transferring the product to the next machine for further processing. According to certain embodiments, as best seen in FIG. 10, the out feed conveyer 32 moves product 2 to an inline width cutting member 34 that cuts the product 2 into strips at desired width. In still further embodiments, as best seen in FIG. 11, the product 2 once cut by the inline width cutting member 34, proceeds to an outflow which may according to certain embodiments, include a water fall type outflow feed 36. As the product 2 falls over the water fall outflow feed 36 the uncut margin breaks resulting in substantial separation of individual strips.

According to certain embodiments, another feature is a variable speed control configuration. According to certain embodiments, the variable speed control configuration serves to coordinate the speeds of the upstream processing feed, the inline skewing conveyer, and the downstream out feed conveyer. In these embodiments, variable speed controls, such as Alan-Bradley components, are in place to allow control of the in-feed conveyor, the rotary cutter and out feed conveyor speeds. The speed control is crucial for synchronizing the product flows to prevent jams in the product flow. For example, if jams or product backup are detected at the rotary head, upstream processing speeds can be slowed until the jams or backup are resolved.

According to certain embodiments, and as best seen in FIG. 11, the final cut product 40 is of a substantially uniform size. The substantially uniform product size produced by the apparatus and system disclosed herein allows more error free operation of downstream equipment. Further, greater uniformity of strip size results in fewer jams in downstream bagger sealing heads caused by irregularly sized final product, especially abnormally long product. Still further, the increased uniformity in the size of the finished product allows for the use of smaller bags and small boxes, the reduced the cost of packing and shipping the finished product.

Although the present invention has been described with reference to preferred embodiments, persons skilled in the art will recognize that changes may be made in form and detail without departing from the spirit and scope of the invention.

What is claimed is:

1. A strip cutter for a product, comprising:

a. an in-feed skewing conveyor having a first side and a second side and comprising:

i. a plurality of substantially parallel conveyance strips defining a substantially horizontal plane for conveying the product;

ii. at least one drive shaft; and iii. a plurality of sprockets of increasing diameter disposed along the drive shaft and substantially parallel to the plurality of conveyance strips from the first side to the second side of the in-feed skewing conveyor, such that smaller sprockets are disposed adjacent to the first side and larger sprockets are disposed adjacent to the second side, wherein the plurality of sprockets are configured to drive the plurality of conveyance strips at an increased speed at the second side so as to rotate the product on substantially horizontal plane of the in-feed skewing conveyor;

b. a housing configured to receive product from the in-feed skewing conveyor the housing comprising a rotating head, wherein the rotating head cuts the product; and c. an out-feed conveyor configured to receive cut product from the housing.

2. The strip cutter of claim 1, wherein the product to be cut has char marks.

3. The strip cutter of claim 2, wherein the product is rotated with respect to the char marks such that the product appears bias cut.

4. The strip cutter of claim 1 wherein the product is meat.

5. The strip cutter of claim 4, wherein the meat is chicken.

6. The strip cutter of claim 4, wherein the meat is cut into strips.

7. The strip cutter of claim 6, wherein the strips are of a substantially uniform size.

8. The strip cutter of claim 1, wherein the rotating head cuts the product leaving an uncut margin.

9. The strip cutter of claim 8, wherein the uncut margin is between about 1/16" and about 1/64" thick.

10. The strip cutter of claim 8, wherein the uncut margin is about 1/32" thick.

11. The strip cutter of claim 1, further comprising a variable speed control configuration.

12. The strip cutter of claim 1, wherein the out-feed conveyor further comprises an inline width cutting member.

13. The strip cutter of claim 1, further comprising a water fall-type feed.

* * * * *